US011745325B2

(12) United States Patent
Tucker et al.

(10) Patent No.: US 11,745,325 B2
(45) Date of Patent: Sep. 5, 2023

(54) PLIER WITH SOCKETS

(71) Applicants: Curt Tucker, Prescott, IA (US); Brenda Rao, Scottsdale, AZ (US)

(72) Inventors: Curt Tucker, Prescott, IA (US); Brenda Rao, Scottsdale, AZ (US)

( * ) Notice: Subject to any disclaimer, the term of this patent is extended or adjusted under 35 U.S.C. 154(b) by 178 days.

(21) Appl. No.: 17/109,557

(22) Filed: Dec. 2, 2020

(65) Prior Publication Data

US 2021/0170562 A1 Jun. 10, 2021

Related U.S. Application Data

(60) Provisional application No. 62/945,945, filed on Dec. 10, 2019.

(51) Int. Cl.

| | |
|---|---|
| ***B25F 1/00*** | (2006.01) |
| ***B25G 1/00*** | (2006.01) |
| ***B25B 7/22*** | (2006.01) |

(52) U.S. Cl.

CPC ..... *B25F 1/003* (2013.01); *B25B 7/22* (2013.01); *B25G 1/00* (2013.01)

(58) Field of Classification Search

CPC ..... B25F 1/003; B25B 7/22; B25G 1/00
USPC ..... 7/127
See application file for complete search history.

(56) References Cited

U.S. PATENT DOCUMENTS

| | | | | |
|---|---|---|---|---|
| 1,657,348 | A * | 1/1928 | Drumm | B25B 7/10 81/417 |
| 3,823,462 | A * | 7/1974 | Kanda | B25B 27/02 29/268 |
| 3,946,453 | A * | 3/1976 | Torres | B25F 1/003 7/138 |
| 4,669,340 | A * | 6/1987 | Igarashi | B25B 7/10 81/394 |
| 4,953,248 | A * | 9/1990 | Trombetta | B25F 1/006 7/137 |
| 5,014,379 | A | 5/1991 | Hull et al. | |
| 5,119,520 | A * | 6/1992 | Finn | B25F 1/003 81/319 |
| 5,280,659 | A | 1/1994 | Park | |
| D367,806 | S * | 3/1996 | Neal | D8/52 |
| 5,910,174 | A | 6/1999 | Finn | |
| 6,223,373 | B1 | 5/2001 | Yeh | |
| D454,290 | S * | 3/2002 | Johnson | D8/58 |
| 8,555,754 | B2 * | 10/2013 | Chen | B25B 7/06 81/416 |
| 2006/0213337 | A1 | 9/2006 | Schuh | |
| 2010/0242183 | A1 | 9/2010 | Redfern | |

* cited by examiner

*Primary Examiner* — Hadi Shakeri
(74) *Attorney, Agent, or Firm* — Boudwin Intellectual Property; Daniel Boudwin

(57) ABSTRACT

A plier with sockets is provided. The device includes a pair of plier members pivotally connected together, each plier member having a handle portion opposite a jaw portion. A first socket is affixed to a first handle portion and includes a first socket opening having a first diameter. A second socket is affixed to a second handle portion and includes a second socket opening having a second diameter. The first and second socket openings are oriented opposite the jaw portions of the pair of plier members. In some embodiments, the first and second socket are removably securable to the first and second handle portions, such that the readily interchange the first and second sockets with sockets of other sizes.

2 Claims, 5 Drawing Sheets

PLIER WITH SOCKETS

CROSS REFERENCE TO RELATED APPLICATIONS

This application claims the benefit of U.S. Provisional Application No. 62/945,945 filed on Dec. 10, 2019. The above identified patent application is herein incorporated by reference in its entirety to provide continuity of disclosure.

BACKGROUND OF THE INVENTION

The present invention relates to pliers with sockets. More particularly, the present invention pertains to a pair of pliers with sockets on each handle portion, wherein the sockets comprise different diameters.

Many individuals use a variety of tools on a job site or around the house. As some tasks are particularly suited for particular tools, individuals must often carry an entire set of tools to be prepared for a variety of tasks. Additionally, several tools may be required over the course of a single task. For example, individuals may find themselves needing to frequently exchange tools between a socket wrench and a pair of pliers over the course of the task. Carrying multiple tools can be particularly cumbersome, particularly if the task is in an elevated position. A user may be required to frequently climb and descend a ladder to retrieve the required tool at a particular moment. This can be exhausting, and repeated trips up and down a ladder risks slipping or falling from the ladder, potentially causing an injury. Furthermore, as these trips may be particularly tiresome, an individual may attempt to accomplish a particular task with a non-ideal tool. For example, an individual may opt to adjust a nut using a pair of pliers when a socket wrench would be ideal. Applying such forces to the nut with a pair of pliers may cause the tool to slip, most frequently risking injury to the individual's hands and knuckles. Therefore, a tool that combines multiple frequently required tools in one is desired.

In light of the devices disclosed in the known art it is submitted that the present invention substantially diverges in design elements from the known art and consequently it is clear that there is a need in the art for an improvement to existing plier and socket systems. In this regard, the instant invention substantially fulfills these needs.

SUMMARY OF THE INVENTION

In view of the foregoing disadvantages inherent in the known types of plier and socket systems now present in the known art, the present invention provides a plier with sockets wherein the same can be utilized for providing convenience for the user when interchangeably using pliers and sockets without needing to exchange or operate multiple separate tools.

The present system comprises a pair of plier members pivotally connected together, each plier member having a handle portion opposite a jaw portion. In some embodiments, a first socket is integrally affixed to a first handle portion and a second socket is integrally affixed to a second handle portion. The first and second socket each include a first and second socket opening, respectively, wherein a first diameter of the first socket opening and a second diameter of the second socket opening are different. In another embodiment, a connector is affixed to a lower end of each handle portion, wherein the connector is configured to removably secure one of a plurality of sockets thereto. Each of the plurality of sockets includes a receiver opposite the socket opening, wherein the receiver is configured to receive the connector therein. In either embodiment, each socket opening is oriented opposite the jaw portion.

In some embodiments, an outer diameter of each of the first and second sockets is identical. In another embodiment, each socket comprises an identical weight. In other embodiments, the pair of plier members are spring biased towards an open position, wherein a linear distance between the jaw portions is greater when in the open position. In yet another embodiment, the first and second handle portions comprise an arcuate shape. In some embodiments, an exterior surface of each of the first handle portion and the second handle portion comprises knurling thereon. In another embodiment, a recess is disposed within each jaw portion, wherein the recess is configured to engage a fastener. In other embodiments, the recess comprises an arcuate shape. In yet another embodiment, a plurality of teeth is disposed along the recess, the plurality of teeth extending between a front side and a rear side of each jaw portion. In some embodiments, a distal end of each jaw portion comprises a planar surface, wherein the planar surface of each jaw portion is configured to rest flush together when in a closed position.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
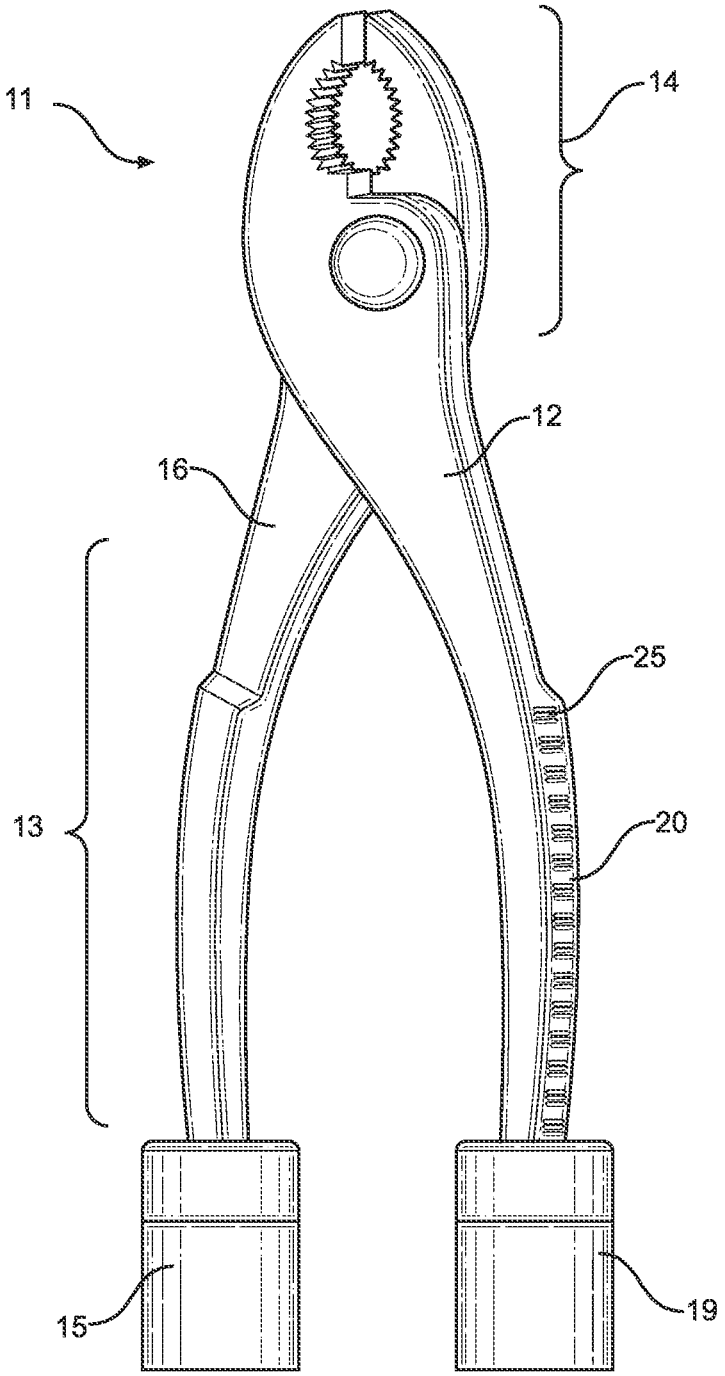
FIG. 1 shows a perspective view of an embodiment of the plier with sockets.

Reference is made herein to the attached drawings. Like reference numerals are used throughout the drawings to depict like or similar elements of the plier with sockets. The figures are intended for representative purposes only and should not be considered to be limiting in any respect.

Referring now to FIG. 1, there is shown a perspective view of an embodiment of the plier with sockets. The plier with sockets 11 comprises a pair of plier members 12 pivotally connected together to form a pair of pliers. Each plier member of the pair of plier members 12 comprises a handle portion 13 opposite a jaw portion 14. In the illustrated embodiment, the handle portions 13 each comprise an arcuate shape configured to provide a comfortable and ergonomic grip, while also increasing the force applied by the jaw portions 14 when the handle portions 13 are closed. In some embodiments, the handle portions 13 are spring biased towards an open position, wherein the open position a linear distance between each of the handle portions 13 and the jaw portions 14 is greater than when in the closed position. Furthermore, in the illustrated embodiment, the handle portions 13 each comprise knurling 25 on an exterior surface thereof, the knurling 25 configured to increase frictional engagement with a user's hand. In some embodiments, the knurling 25 extends along an entirety of the exterior surface, whereas, in the shown embodiment, the knurling 25 is disposed in a series of distinct and separate rows along the handle portions 13. In this manner, less material is required to form the knurling 25 while still increasing frictional engagement with a user's hand.

Figure 2:
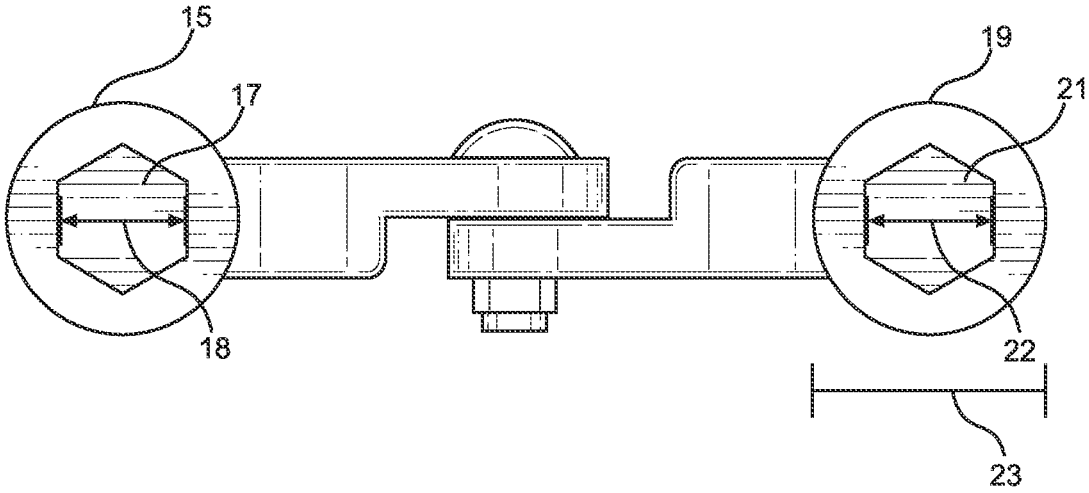
FIG. 2 shows a lower plan view of an embodiment of the plier with sockets.

A first socket 15 is disposed on a lower end of a first handle portion 16 of the pair of handle portions 13. In the illustrated embodiment, the first socket 15 is integrally affixed to the first handle portion 16, so as to increase structural integrity of the plier with sockets 11 as a whole. The first socket 15 comprises a first socket opening (as shown in FIG. 2, 17), wherein the first socket opening is oriented opposite the jaw portion 14. Similarly, a second socket 19 is disposed on a lower end of a second handle portion 20 of the pair of handle portions 13. In the shown embodiment, the second socket 19 is integrally affixed to the second handle portion 20. The second socket 19 comprises a second socket opening (as shown in FIG. 2, 21), wherein the second socket opening is oriented opposite the jaw portion 14. In this manner, the user can simply rotate the plier with sockets 11 to utilize the first and second sockets 15, 19 after utilizing the jaw portions 14 of the pliers.

Referring now to FIG. 2, there is shown a lower plan view of an embodiment of the plier with sockets. As previously described, the first socket 15 and the second socket 19 each include a first socket opening 17 and a second socket opening 21, respectively. A first diameter 18 of the first socket opening 17 comprises a different length than a second diameter 22 of the second socket opening 21. In this manner, each of the first and second sockets 15, 19 can be utilized with differently sized fasteners, such as nuts, thereby reducing the number and weight of tools required in order to perform various construction tasks. In the illustrated embodiment, an outer diameter 23 of each of the first and second sockets 15, 19 is identical, such that the plier with sockets is relatively balanced during use. Similarly, in some embodiments, a weight of each of the first and second sockets 15, 19 is identical to ensure that the plier with sockets is balanced. Alternatively, in another embodiment, the outer diameter 23 of each of the first and second sockets 15, 19 is different, such that the user can visually identify a size of each of the first and second socket openings 17, 21 at a glance.

Figure 3:
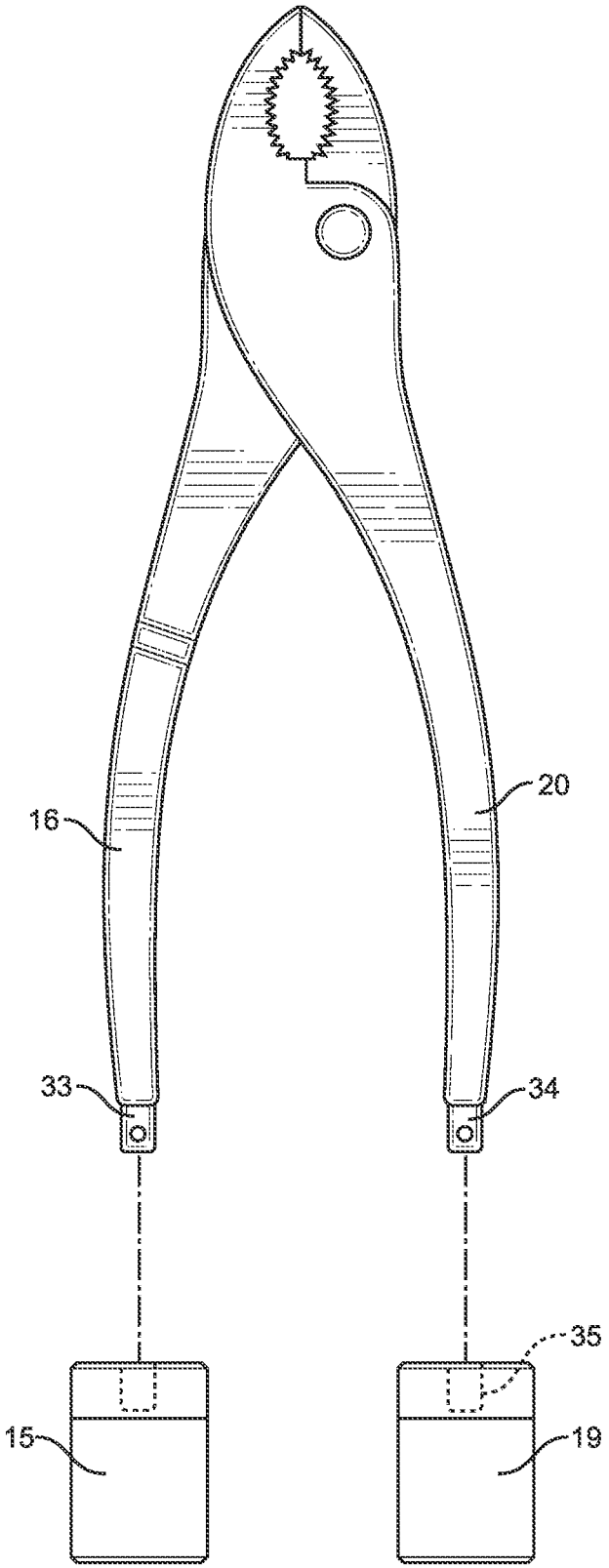
FIG. 3 shows an exploded view of an alternate embodiment of the plier with sockets.

Referring now to FIG. 3, there is shown an exploded view of an alternate embodiment of the plier with sockets. In the illustrated embodiment, the first and second sockets 15, 19 are removably securable to the first and second handle portions 16, 20, respectively. A first connector 33 is affixed to a lower end of the first handle portion 16, and a second connector 34 is affixed to a lower end of the second handle portion 20, wherein the first and second connectors 33, 34 are configured to selectively engage the first socket 13 and the second socket 19 respectively. Each of the first and second sockets 15, 19 includes a receiver 35 therein opposite each socket opening. The receiver 35 is configured to selectively engage each of the first and second connectors 33, 34 to secure the first and second sockets 15, 19 to the pair of plier members. In some embodiments, the first and second connectors 33, 34 include a ball-detent mechanism configured to selectively engage the receiver 35, whereas, in alternate embodiments, the receiver 35 is configured to magnetically engage each of the first and second connectors 33, 34. In some embodiments, the first and second sockets 15, 19 are selected from a plurality of available sockets, each having a different socket opening diameter, such that the user can select a necessary socket for a particular task. In this manner, the user need not be restricted to two particular socket sizes and can readily interchange each of the first and second sockets 15, 19 for alternative sockets.

Figure 4:
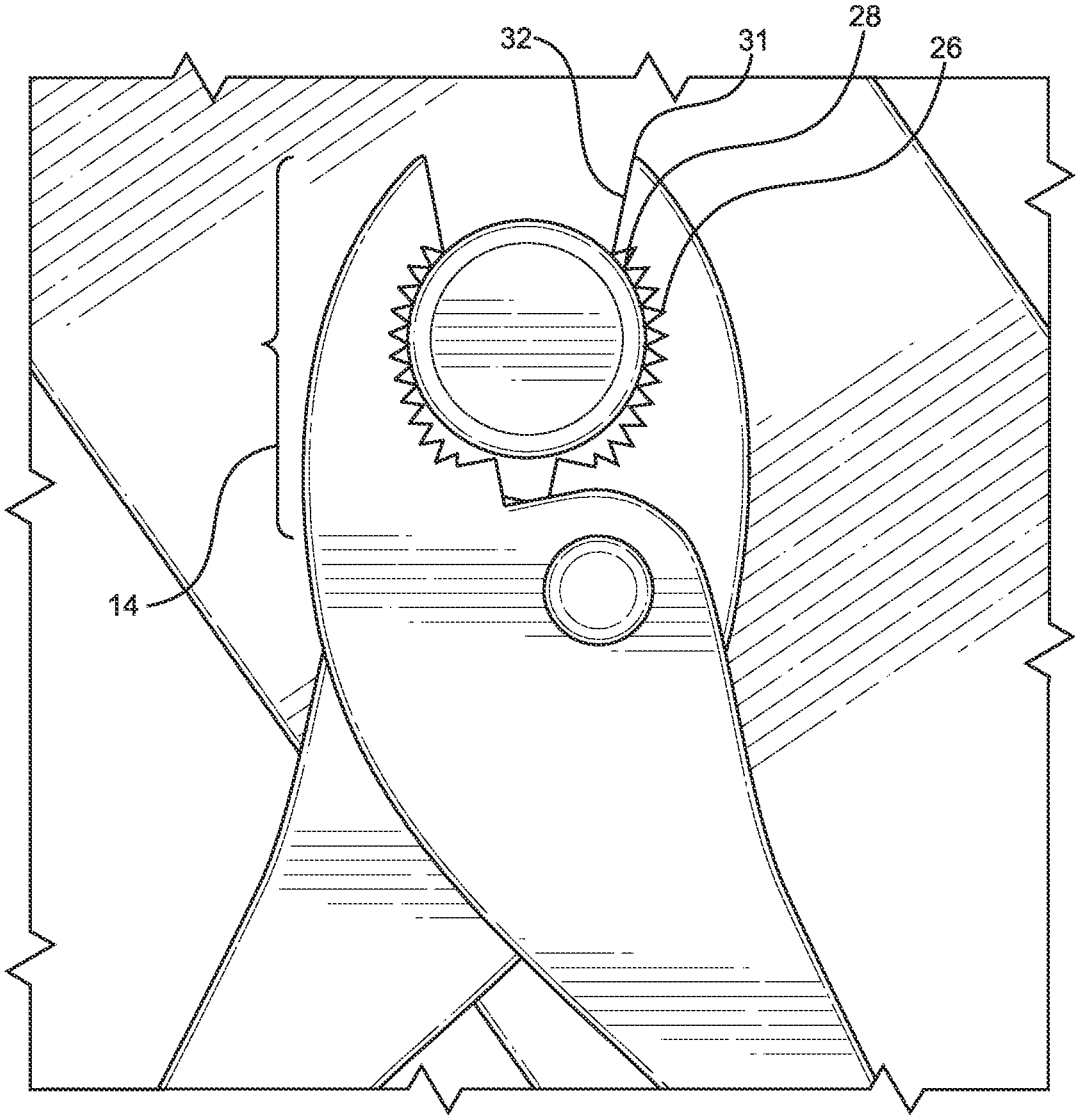
FIG. 4 shows a close-up view of the jaw portion of an embodiment of the plier with sockets.

Referring now to FIG. 4, there is shown a close-up view of the jaw portion of an embodiment of the plier with sockets. In the illustrated embodiment, each of the jaw portions 14 includes a recess 26 configured to frictionally engage a fastener along an interior surface thereof. In the shown embodiment, the recess 26 comprises an arcuate shape configured to conform to the substantially rounded shape of nuts, bolts, and other fasteners. In the illustrated embodiment, the recess 26 further comprises a plurality of teeth 28 therein, wherein the plurality of teeth 28 extend transversely across the recess 26 between a front side and a rear side of each jaw portion 14. In this manner, the plurality of teeth 28 are configured to increase the surface area in contact with a desired fastener and therefore increase frictional engagement therewith. Additionally, in the shown embodiment, a distal end 31 of each jaw portion 14 comprises a planar surface 32 wherein the planar surfaces 32 of the opposing jaw portions 14 are configured to rest flush together when in the closed position. In this manner, the planar surfaces 32 act as stoppers, preventing the fastener from sliding from within the grasp of the jaw portions 14, Furthermore, the planar surface 32 provides a separately shaped interface for engaging a particular fastener, such as one having planar sides. In some embodiments, the planar surface 32 further comprises a textured surface to increase frictional engagement.

Figure 5:
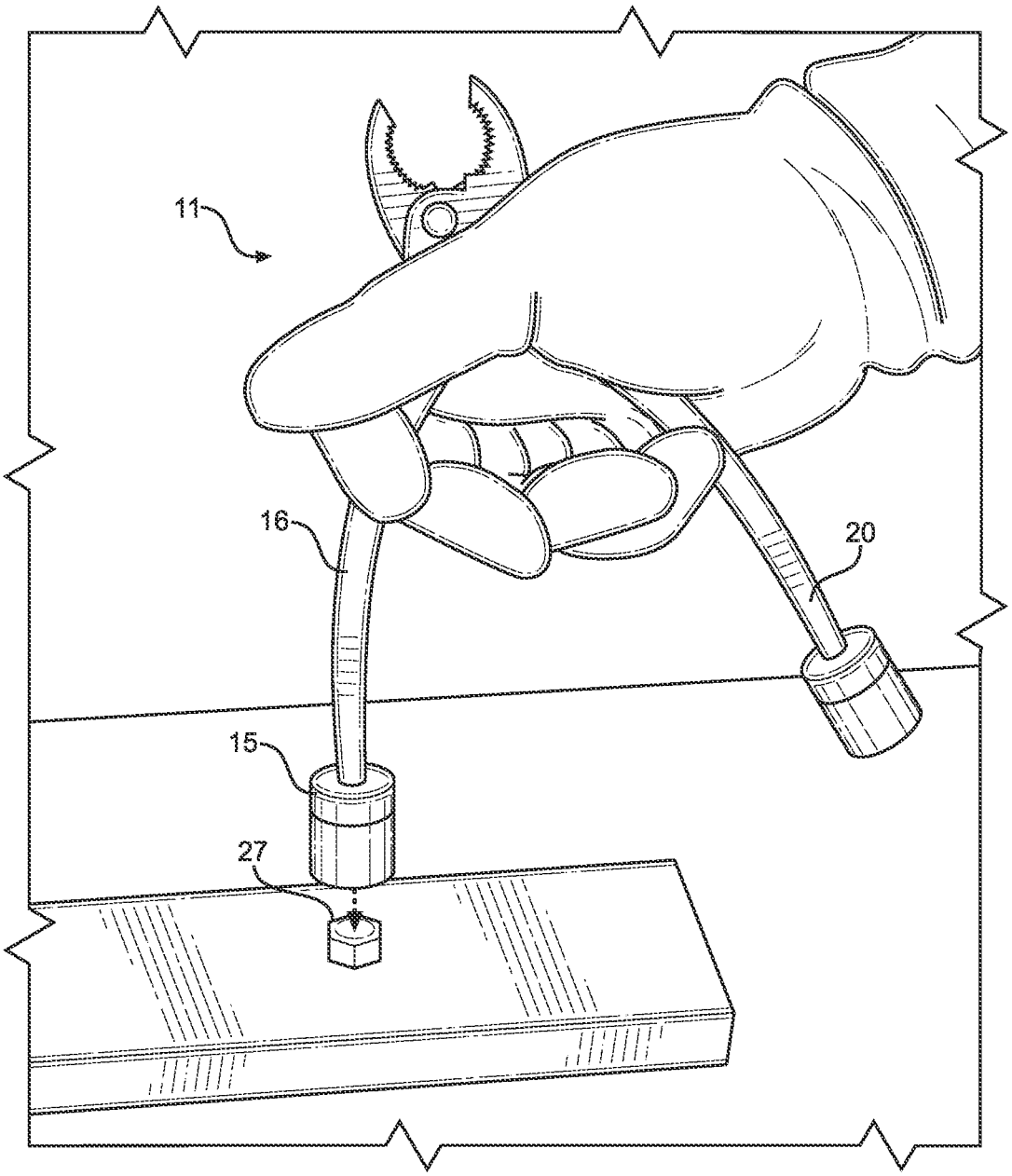
FIG. 5 shows a perspective view of an embodiment of the plier with sockets in use.

Referring now to FIG. 5, there is shown a perspective view of an embodiment of the plier with sockets in use. In one use, the plier with sockets 11 can be utilized to grasp and rotate objects or fasteners via the jaw portions as with traditional pliers. When a fastener 27 needs to be tightened, as typical with a traditional socket wrench, the user can simply alter the grip on the plier with sockets 11 to engage a first socket 15 or another socket with the fastener 27. The user can then open the plier with sockets 11 such that the second handle portion 20 is disposed substantially perpendicular to the first handle portion 16, thereby allowing the user to maximize the torque applied to rotating the fastener 27 within the first socket 15. Once the fastener 27 is properly tightened, the user can then return to utilizing the jaw portions to grasp objects as necessary to complete a task. In some embodiments, the user can further exchange the first socket 15 with a separate socket having a different socket diameter to engage fasteners 27 of different sizes. In this way, the user can readily complete a task at a worksite without carrying a large number of tools or making several trips to a toolbox.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A plier with sockets, comprising:

a pair of plier members pivotally connected together, each plier member having a handle portion opposite a jaw portion;

a first socket integrally affixed to a first handle portion;

wherein the first socket comprises a first socket opening having a first diameter;

a second socket integrally affixed to a second handle portion;

wherein the second socket comprises a second socket opening having a second diameter;

wherein the first and second socket openings are oriented opposite the jaw portions of the pair of plier members;

wherein an outer diameter of each of the first socket and the second socket is identical; wherein the first socket and the second socket comprise an identical weight;

wherein the first and second handle portions each comprise an arcuate shape;

further comprising a recess within each jaw portion, the recess configured to engage a fastener; wherein the recess comprises an arcuate shape;

wherein the first handle and the second handle can extend perpendicular to each other;

wherein the first handle and the second handle can pivotally open to a 90-degree angle;

further an exterior surface of each of the first handle portion and the second handle portion comprises knurling thereon;

wherein the knurling in configured to increase frictional engagement allowing maximum torque; further comprising a plurality of teeth disposed along the recess, the plurality of teeth extending between a front side and a rear side of each jaw portion; and wherein a distal end of each jaw portion comprises a planar surface, wherein the planar surface of each jaw portion is configured to rest flush together when in a closed position.

2. A plier with sockets, comprising:

a pair of plier members pivotally connected together, each plier member having a handle portion opposite a jaw portion;

a connector affixed to a lower end of each handle portion;

a plurality of sockets, wherein each socket of the plurality of sockets comprises a socket opening on a first end of the socket and a receiver on a second end of the socket;

wherein the receiver is configured to removably secure to the connector, such that the socket opening is oriented opposite the jaw portions of the pair of plier members;

wherein the socket opening of each of the plurality of sockets comprises a different diameter;

wherein an outer diameter of each of the first socket and the second socket is identical; wherein the first socket and the second socket comprise an identical weight;

wherein the first and second handle portions each comprise an arcuate shape;

further comprising a recess within each jaw portion, the recess configured to engage a fastener; wherein the recess comprises an arcuate shape;

wherein the first handle and the second handle can extend perpendicular to each other;

wherein the first handle and the second handle can pivotally open to a 90-degree angle;

further an exterior surface of each of the first handle portion and the second handle portion comprises knurling thereon;

wherein the knurling in configured to increase frictional engagement allowing maximum torque; further comprising a plurality of teeth disposed along the recess, the plurality of teeth extending between a front side and a rear side of each jaw portion; and wherein a distal end of each jaw portion comprises a planar surface, wherein the planar surface of each jaw portion is configured to rest flush together when in a closed position.

* * * * *